US005373895A

United States Patent [19]

Yamamoto et al.

[11] Patent Number: 5,373,895

[45] Date of Patent: Dec. 20, 1994

[54] HEAT EXCHANGER

[75] Inventors: Michiyasu Yamamoto, Chiryu; Yoshio Suzuki, Nishikamo; Ryouichi Sanada, Kariya, all of Japan

[73] Assignee: Nippondenso Co., Ltd., Kariya, Japan

[21] Appl. No.: 975,576

[22] Filed: Apr. 7, 1993

[30] Foreign Application Priority Data

Aug. 10, 1990 [JP] Japan ..... 2-211909

[51] Int. Cl.[5] ..... F28D 1/03

[52] U.S. Cl. ..... 165/148; 165/151

[58] Field of Search ..... 165/148, 151

[56] References Cited

U.S. PATENT DOCUMENTS

| | | | |
|---|---|---|---|
| 1,140,494 | 5/1915 | Boblett | 165/148 |
| 1,233,429 | 7/1917 | Williams | 165/148 |
| 1,296,058 | 3/1919 | Fedders | 165/148 |
| 1,346,442 | 7/1920 | Clausing | 165/148 |
| 2,066,279 | 12/1936 | Przyborowski | 165/148 X |
| 2,339,284 | 1/1944 | Modine | 165/148 X |
| 4,738,225 | 4/1988 | Juang | 122/367 C |
| 4,958,681 | 9/1990 | Kadle | 165/151 |
| 5,099,914 | 3/1992 | Reifel | 165/151 |

FOREIGN PATENT DOCUMENTS

| | | |
|---|---|---|
| 370786 | 2/1907 | France . |
| 459874 | 5/1928 | Germany . |
| 873921 | 4/1953 | Germany . |
| 54-6664 | 1/1979 | Japan . |
| 56-000150 | 1/1981 | Japan . |
| 56-121994 | 9/1981 | Japan . |
| 56-168093 | 12/1981 | Japan . |
| 63-159669 | 10/1988 | Japan . |
| 277594 | 9/1927 | United Kingdom . |

*Primary Examiner*—Allen J. Flanigan

*Attorney, Agent, or Firm*—Cushman, Darby & Cushman

[57] ABSTRACT

A heat exchanger is formed by the stacked lamination of a plurality of core elements formed from a single material. The core elements are substantially U-shaped with an upper surface having fins for allowing a first heat medium to pass therethrough, side plates extending substantially perpendicular to the ends of the upper surface for joining adjacent core elements, and tube portions formed between the side plates of joined adjacent core elements. The core elements are stacked and joined to thereby form a finned passageway allowing a first heat medium to pass therethrough in a first direction, and a tube passageway allowing a second heat medium to pass therethrough in a second direction which is perpendicular to the first direction. The design allows for adjustment of the cross-sectional area of the tube passageway without causing an increase in the pressure caused by the finned passageway.

10 Claims, 21 Drawing Sheets

HEAT EXCHANGER

BACKGROUND OF THE INVENTION

1. Field of the Invention

The present invention relates to a heat exchanger mounted on a motor vehicle and to, for example, a heat exchanger used as a radiator or heater core.

2. Background of the Related Art

Japanese laid-open utility model S54-6664 and Japanese laid-open utility model S63-159669 disclose a laminated heat exchanger 700 as shown in FIG. 30 and FIG. 31 wherein tubes 702 are formed by laminating a plurality of fin plates 701. Each fin plate 701 has a tapered cylindrical portion 703 formed by drawing. The cylindrical portions 703 are aligned in the vertical direction in the figure. The tubes 702 in this type of laminated heat exchanger 700 are formed by laminating and joining a plurality of fin plates 701.

In this type of laminated heat exchanger 700, to maintain the strength of the joint between the adjoining cylindrical portions 703 to thereby prevent the adjoining cylindrical portions 703 from separating from each other, the cylindrical portions 703 project from the flat surfaces of the fin plates 701 by a relatively large amount to maintain the surface area in which the adjoining cylindrical portions are joined.

However, in the conventional laminated heat exchanger 700, the thickness CB1 of each tube 702 (refer to FIG. 30 and FIG. 31) becomes large when the cylindrical portions 703 are projected from the flat surfaces of the fin plates 701 by a relatively large amount as described above.

This increases a pressure loss in the air flowing between the tubes 702, thereby reducing the flow capacity of the air flowing through the core portion 704. In addition, the proportion of the fin plates 701 to the whole core portion 704 is reduced. This has resulted in a problem in that the efficiency of the heat exchange between the air and the engine cooling water and, consequently, the heat radiating performance of the fin plates 701 is degraded.

An object of the present invention is to provide a heat exchanger wherein the heat radiating performance of the fin plates is improved by improving the heat exchange efficiency.

SUMMARY OF THE INVENTION

In order to achieve the above-described object, a first laminated body is formed by laminating a plurality of core elements, each comprising a fin plate disposed along the flowing direction of a first heat medium, two side plates which provided at side end portions, the fin plate extending along the flowing direction of the first heat medium and extended in a direction substantially perpendicular to a flat surface portion of the fin plate, at least two flat plate portions provided at each of the two side plates so that they are spaced from each other in the flowing direction of the first heat medium, and a flow path forming portion forming a difference in level which is inward of at least either of the flat plate portions on at least either of the side plates between the flat plate portions, so that the flat plate portions of the side plates and the flow path forming portions form continuous flat surfaces. A second laminated body is formed in the same way as the first laminated body is joined so that each flat surface formed by two adjoining flat plate portions at the side of the first laminated body on which the flow path forming portions form a continuous flat surface faces each flat surface formed by two adjoining flat plate portions at the side of the second laminated body corresponding to the side of the first laminated body opposite to the side thereof on which the flow path forming portions form a continuous flat surface to form a flow path inside the flat surfaces thus joined which extends in the laminating direction of the core elements and through which a second heat medium flows, allowing the first heat medium and the second heat medium to exchange heat.

If the first and second laminated bodies are preferred as first and second core elements, respectively, and the fin plates, side plates and flat plate portions are preferred as first and second fin plates, first and second side plates and first and second flat plate portions, respectively, a flow path through which the second heat medium flows is formed between the first side plate and the second side plate by joining a plurality of first flat plate portions of the first side plates provided at one end of the first fin plate of the first core element and a plurality of second flat plate portions of the second side plates provided at the other end of the second fin plate of the second core element so that their surfaces contact each other.

A reduction in the thickness of the tube does not result in a reduction in the size of the portion where the plurality of first plate portions and the plurality of second flat plate portions are joined. Accordingly, the strength of the joint between the first and second core elements is sufficiently maintained even if the thickness of the tube is reduced, and the first and second side plates do not separate from each other. Therefore, it is possible to reduce the thickness of the tube. This allows a reduction in the pressure loss in the first heat medium flowing outside the tube in the core portion, thereby allowing the capacity of the first heat medium introduced into the core portion to be increased. This also makes it possible to reduce the proportion of the tube to the whole core portion and, conversely, to increase the proportion of the first and second fin plates to the whole core portion.

Furthermore, since it is possible to improve the efficiency of heat exchange at the core portion, there is an effect that the heat radiating performance of the first and second fin plates is improved.

The present invention also provides joint flaps joined to the first and second core elements to be laminated which are bent in a shape like a hook are provided at the tips of the first and second side plates. This facilitates the joint of the first and second core elements and the first and second core elements laminated on the first and second core elements, respectively, and improves the strength of the joint between the first and second core elements which are laminated.

BRIEF DESCRIPTION OF THE DRAWINGS

FIG. 1 is a perspective view showing a part of a core portion of a laminated heat exchanger;

FIG. 2 is an enlarged side view of a part of FIG. 1;

FIG. 3 is a sectional view showing a laminated heat exchanger;

FIG. 4 is a perspective view showing a core element;

FIG. 5 is a sectional view showing a fin plate;

FIG. 6 is a perspective view showing the first process of a method of forming a core element;

FIG. 7 is a perspective view showing a molded part formed by the first process;

FIG. 8 is a perspective view showing the second process of the method of forming a core element;

FIG. 9 is a perspective view showing a molded part formed by the second process;

FIG. 10 is a perspective view showing the third process of the method of forming a core element;

FIG. 11 is a perspective view showing a molded part formed by the third process;

FIG. 12 is a perspective view showing the fourth process of the method of forming a core element;

FIG. 13 is a perspective view showing a molded part formed by the fourth process;

FIG. 14 is a perspective view showing a core element at an end portion;

FIG. 17 is a sectional view showing a core portion of a laminated heat exchanger;

FIG. 18 is a side view showing a core portion of a laminated heat exchanger;

FIG. 19 is a perspective view showing a core element;

FIG. 20 is a perspective view showing a core element at an upper end portion;

FIG. 21 is a perspective view showing a core element at a lower end portion;

FIG. 22 is a sectional view showing a core portion of a laminated heat exchanger;

FIG. 23 is a perspective view showing a core element at an upper end portion;

FIG. 24 is a perspective view showing a core element at a lower end portion;

DETAILED DESCRIPTION OF THE PREFERRED EMBODIMENT

Figure 1:
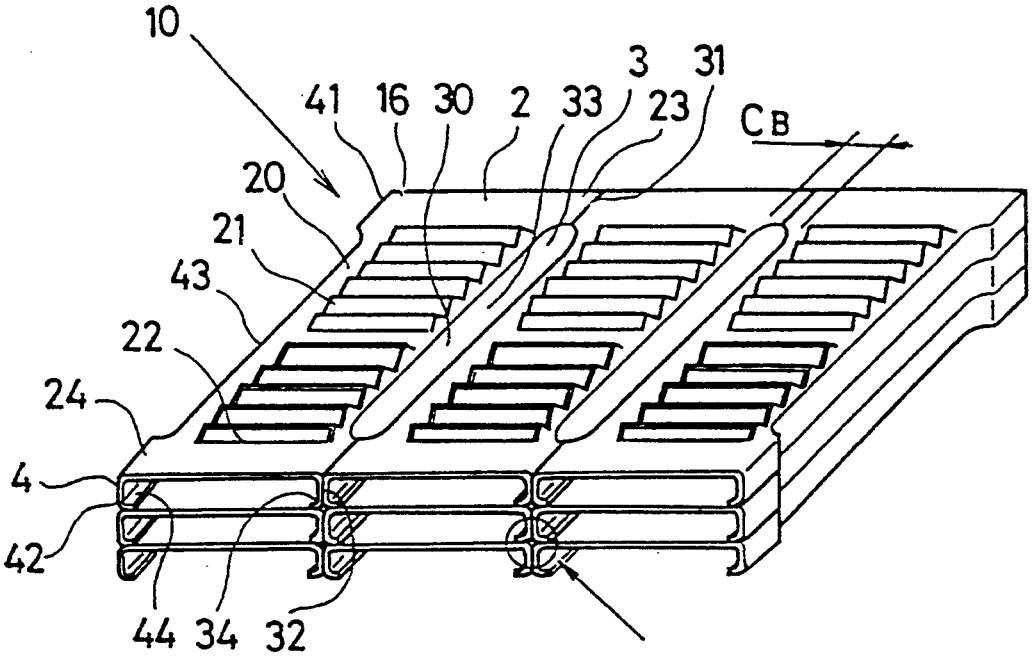
FIG. 1 to FIG. 14 show a first embodiment of the present invention.
Figure 2:
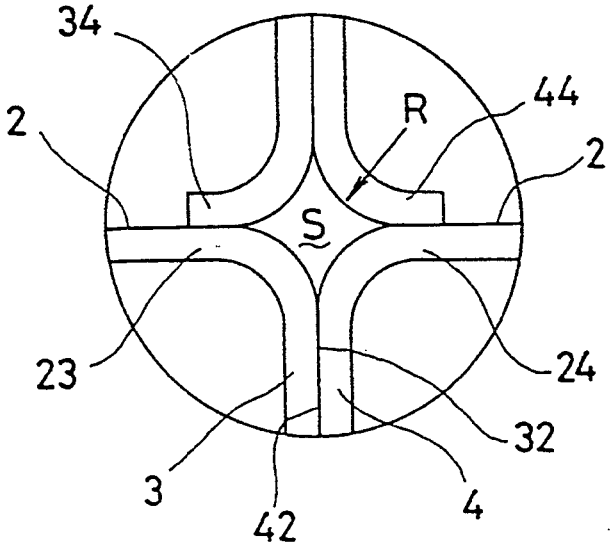
Figure 3:
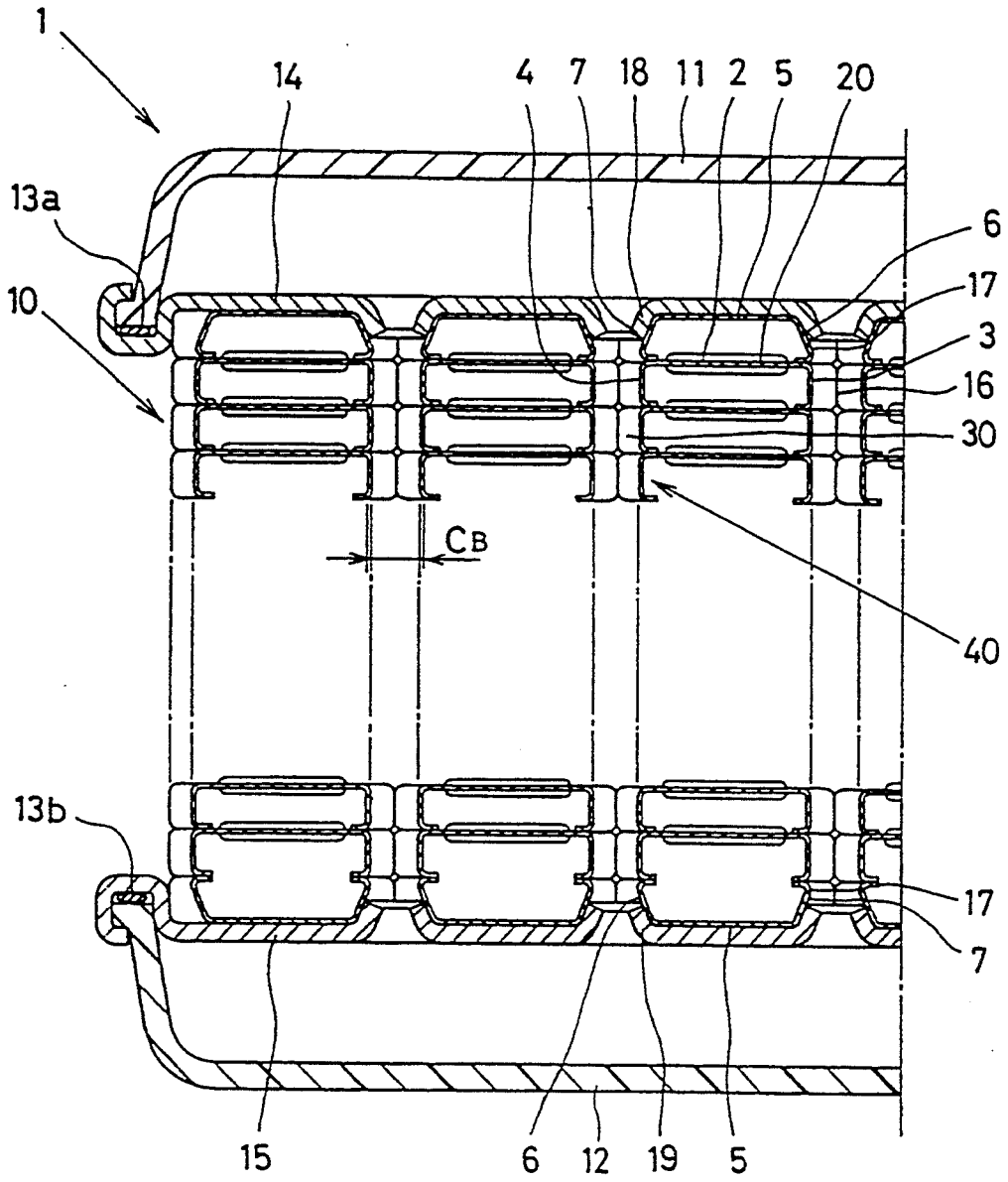

The structure of a core portion of a laminated heat exchanger according to the present invention is described with reference to embodiments shown in FIG. 1 to FIG. 25. FIG. 1 to FIG. 14 show a first embodiment of the present invention. FIG. 1 shows a part of a core portion of a laminated heat exchanger. FIG. 2 is an enlarged view of a part of FIG. 1. FIG. 3 shows a laminated heat exchanger. A laminated heat exchanger 1 is used, for example, as a radiator of a vehicle engine and comprises a core portion 10 for performing heat exchange between the air and engine cooling water as fluids and upper and lower tanks 11 and 12 for temporarily storing the engine cooling water. A packing 13a for preventing leakage of the engine cooling water is disposed at a portion wherein the upper tank 11 an the core portion 10 are joined. Similarly, a packing 13*b* is disposed at a portion wherein the lower tank 12 and the core portion 10 are joined. The core portion 10 comprises upper and lower core plates 14 and 15, a plurality of core elements 16, and a plurality of core elements 17 at end portions. The upper and lower core plates 14 and 15 are made of aluminum thin plates and are caulk-joined to the upper tank 11 and lower tank 12, respectively, at outer peripheral portions thereof. The upper and lower core plates 14 and 15 have a plurality of tapered cylindrical portions 18 and 19 projected toward the plurality of core elements 17 at end portions, which are provided as plate-like portions thereof joined to the core elements 17 at end portions. The plurality of tube portions 18 and 19 are formed by performing a deep drawing process (burning process) on the upper and lower core plates 14, 15.

Figure 4:
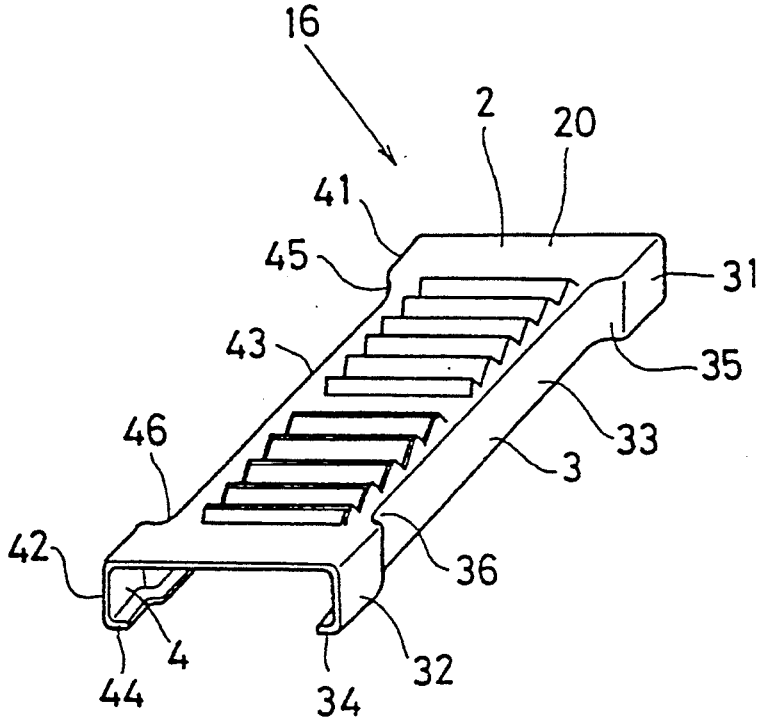

FIG. 4 shows a core element 16. The core elements 16 are the first and second core elements of the present invention. They are substantially U-like in sectional shape and are disposed in plurality along the flow direction of the air. A core element 16 comprises a fin plate 2 and side plates 3 and 4. The fin plates 2 are the first and second fin plates of the present invention and are disposed on the same plane to constitute a fin portion 20 for promoting heat exchange between the air and engine cooling water.

Figure 5:
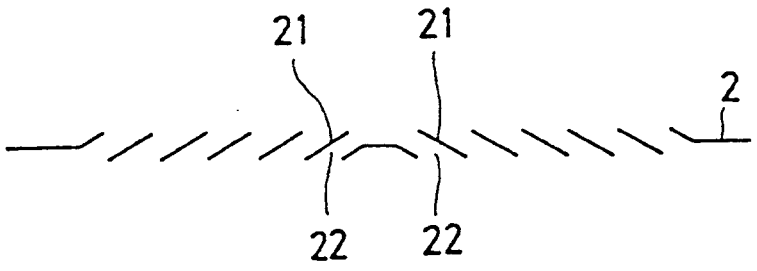

As shown in FIG. 5, the fin plate 2 is formed with a plurality of louvers 21 and a plurality of slits 22 to improve the heat radiating performance of the fin plate 2. Furthermore, the fin plate 2 has joint portions 23, 24 on the side portion at one and the other ends thereof, which are joined to a core element 16 laminated on the level immediately above it.

Side plate 3 on the one side and side plate 4 on the other side are the first and second side plates of the present invention. The side plates 3 and 4 on one and other sides have inlet-side flat plate portions 31, 41, outlet-side flat plate portions 32, 42, tube portions 33, 43, and joint flaps 34, 44, respectively. The inlet-side flat plate portions 31 and 41 are disposed on side plates 3, 4 at the upstream side with respect to the flowing direction of the air, i.e., at the side of an inlet portion through which the air flows into the core portion 10. These inlet-side flat plates 31, 41 extend in a direction perpendicular to the plane of the fin plate 2 (downward in FIG. 1) from the side portions at one and the other end portions of the fin plate 2.

The inlet-side flat plate portion 31 of the side plate 3 on one side is joined to the inlet-side flat plate 41 of the side plate 4 on the other side of the adjoining core element 16 so that their surfaces contact each other. The outlet-side flat plate portions 32, 42 are disposed at the side opposite to the inlet-side flat plate portions 31, 41, i.e., at the side of an outlet portion through which the air exits from the core portion 10. These outlet-side flat plates 32, 42 extend in the same direction as that of the inlet-side flat plate portions 31, 41 (downward in FIG. 1) from the side portions at the other end portion of the fin plate 2. The outlet-side flat plate portion 32 of the side plate 3 on the one side is joined to the outlet-side flat plate 42 of the side plate on the other side of the adjoining core element 16 so that their surfaces contact each other.

The tube portions 33, 43 are bay-like portions of the present invention and are disposed between the inlet-side flat plate portions 31, 41 and the outlet-side flat plate portions 32, 42. The tube portions 33, 43 have their side portions in positions which are recessed from the side surfaces of the inlet-side flat plate portions 31, 41 and the outlet-side flat plate portions 32, 42.

Corner portions 35, 36, 45, 46 which connect the flat surfaces of the tube portions 33, 43 to the flat surfaces of the inlet-side flat plate portions 31, 41 and the flat surfaces of the outlet-side flat plate portions 32, 42 are provided at the end portions of the tube portions 33, 43 on the upstream side and downstream side of the flowing direction of the air. A flow path 30 through which engine cooling water flows is formed between the tube portions 33, 43 of adjoining core elements 16.

Furthermore, the tube portions 33, 43 are converted into a tube 40 in an arbitrary length by laminating an arbitrary number of core elements 16. The joint flaps 34, 44 are the tips of the inlet-side flat plate portions 31, 41, outlet-side flat plate portions 32, 42, and the tube portions 33, 43 which are inwardly bent in the form of hooks so that they are in parallel with the fin plate 2. The joint flaps 34, 44 are brazed to joint portions 23, 24, respectively, of a fin plate 2 of a core element 16 which is laminated on the level immediately thereunder.

Figure 6:
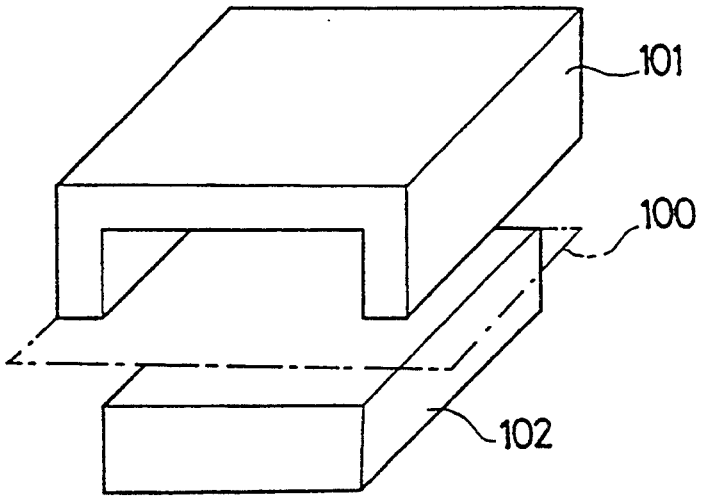
Figure 7:
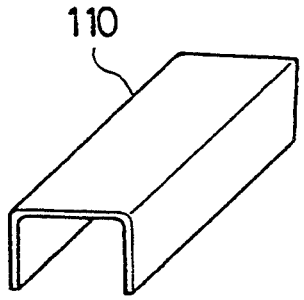

The method of forming the core element 16 is described with reference to FIG. 6 to FIG. 13. In the first process, a material 100 comprising an aluminum thin plate claded by a brazing material of, for example, about 0.06 mm to 0.15 mm is bent as shown in FIG. 6 using a U-shaped upper mold 101 and a rectangular lower mold 102 to form it into a molded part 110 having a U-like sectional shape as shown in FIG. 7.

Figure 8:
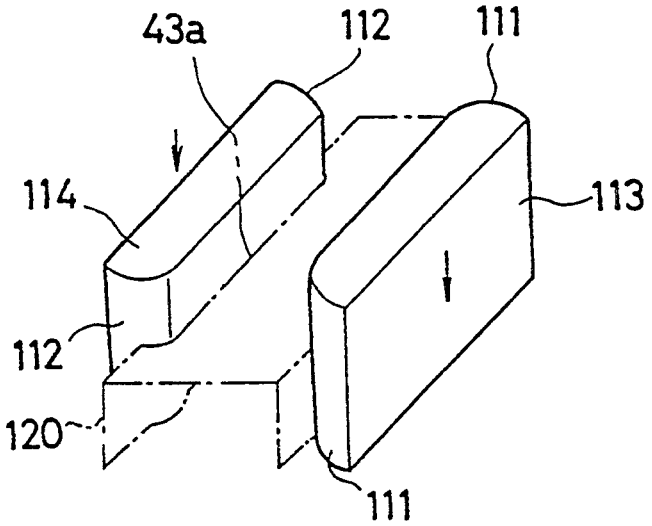
Figure 9:
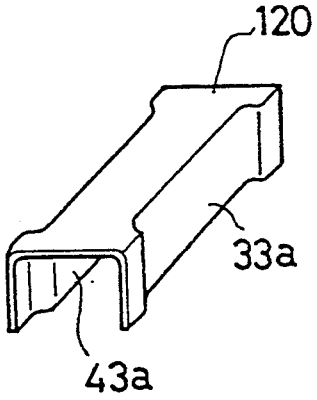
Figure 10:
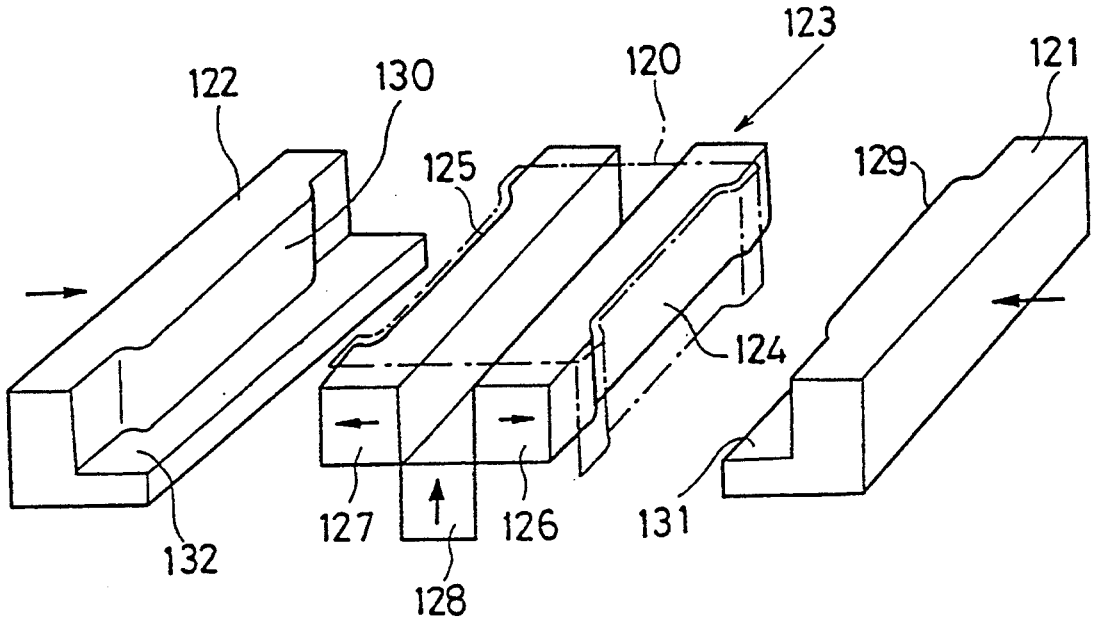

Next, in the second process, the molded part 110 is reduced by a pair of molds 113, 114 having curved surfaces 111, 112, respectively, at both ends thereof as shown in FIG. 8 to form tube portions 33*a*, 43*a* on a molded part 120 as shown in FIG. 9.

In the third process, the molded part 120 is processed by a pair of molds 121, 122 and a split mold 123 inserted into the molded part 120 to form the joint flaps 34, 44 and to finish the tube portions 33, 43. In this third process, after the joint flaps 34, 44 are formed, the split mold 123 is split into three pieces in order to remove the split mold 123 from the molded part 120. Specifically, the split mold 123 comprises a pair of molds 126, 127 having concave portions 124; 125 for forming the tube portions 33, 43 and a mold 128 which moves upward and downward to move the molds 126, 127 from side to side after the joint flaps 34, 44 are formed.

Figure 11:
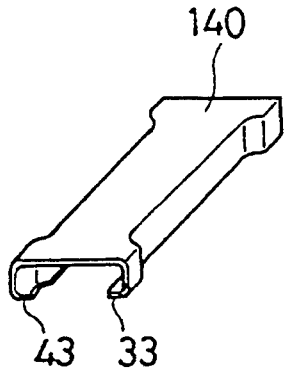

The third process is described in detail. When the pair of molds 126, 127 are inserted in the molded part 120, the mold 128 moves upward to push the pair of molds 126, 127 aside so that they separate from each other. At this time, a press process is performed, wherein the pair of molds 121, 122 having convex portions 129, 130 such that they fit the concave portions 124, 125 of the pair of molds 126, 127 and L-shaped portions 131, 132 for forming the joint flaps 34, 44 sandwiches the molded part 120 in cooperation with the pair of molds 126, 127. The tube portions 33, 43 and the joint portions 34, 44 are thus formed on a molded part 140 as shown in FIG. 11.

Figure 12:
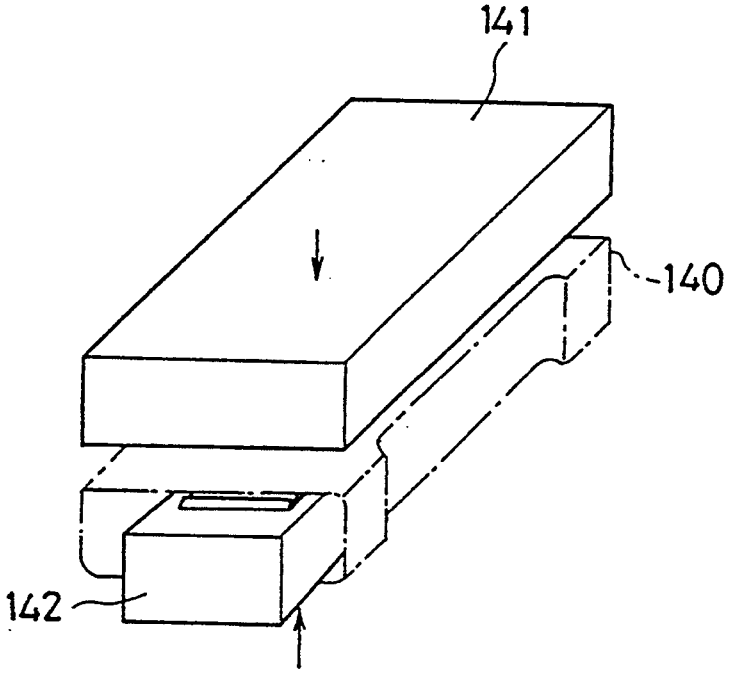
Figure 13:
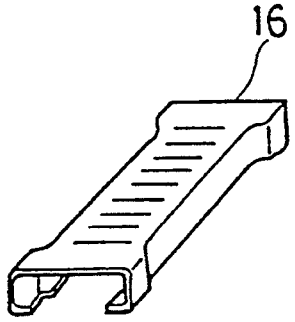
Figure 14:
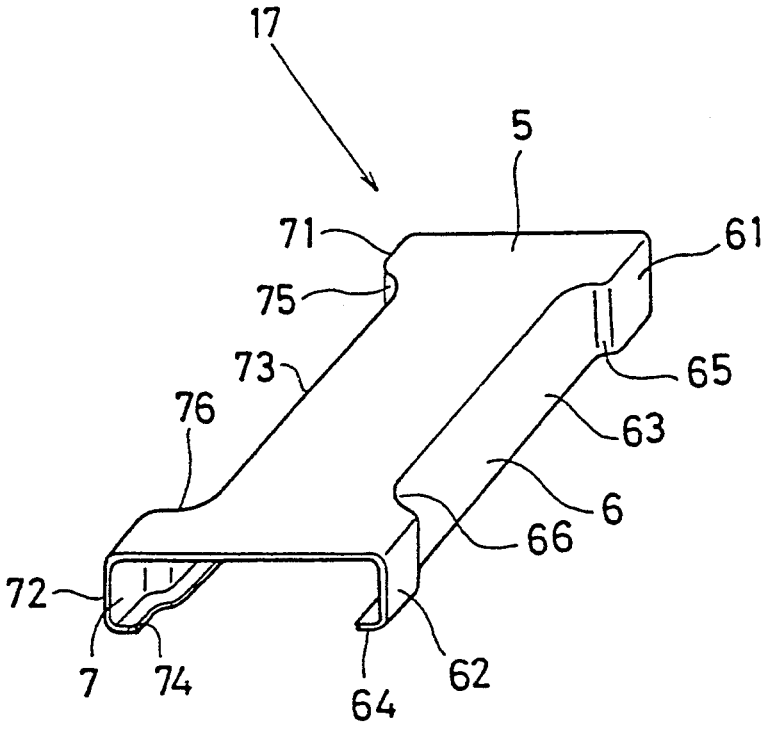

In the fourth process, the fin plate 2 is press-processed using an upper mold 141 and a lower mold 142 as shown in FIG. 12 to form a plurality of louvers 21 and a plurality of slits 22, thereby forming a core element 16 as shown in FIG. 13. FIG. 14 shows a core element 17 at an end portion. The core element 17 at an end portion comprises a connecting plate 5 and side plates 6, 7 on one and the other sides thereof. The connecting plate 5 has a flat surface and is brazed to upper and lower core plates 14, 15. The side plates 6, 7 on one and the other sides are similar in construction to the side plates 3, 4 on the one and the other sides and have inlet-side flat plate portions 61, 71, outlet-side flat plate portions 62, 72, tube portions 63, 73 and joint flaps 64, 74, respectively. Just as in the tube portions 33, 43, corner portions 65, 66, 75, 76 are formed on the tube portions 63, 73. Cylindrical portions 18, 19 of the upper and lower core plates 14, 15 are inserted in the flow path 30 formed by the tube portions 63, 73. Furthermore, the joint flaps 64, 74 of a core element 17 at the upper end are brazed to joint portions 23, 24, respectively, of a core element 16 on the uppermost level. The joint flaps 64, 74 of a core element 17 at the lower end are brazed to joint portions 34, 44, respectively, of a core element 16 on the lowermost level.

The operation of the core portion 10 of the laminated heat exchanger of the present embodiment is described with reference to FIG. 1 to FIG. 4. Since the upper and lower core plates 14, 15, the core elements 16 and the core elements 17 at the end portions are clad with a brazing material on their surfaces, the upper and lower core plates 14, 15, the core elements 16 and the core elements 17 at the end portions are joined to form a core portion 10 by assembling them and heating them in a furnace under pressure. At this time, fin portions 20 for improving heat exchange between the air and engine cooling water are formed by the fin plates 2 of the core elements 16. In addition, tubes 40 are formed in the vertical direction of the laminated heat exchanger 1 (the flowing direction of the cooling water) by the tube portions 33, 43 of the adjoining core elements 16 and the tube portions 63, 73 of the adjoining core elements 17 at the end portions.

As shown in FIG. 2, there is a concern for leakage of water through a gap portion S after the brazing. However, if the thickness of the core element 16 is about 0.1 mm, the bending angle R defined between the side portions at one and the other ends of the fin plate 2 and the joint flaps 34, 44 can be reduced to about 0.2 mm. As a result, the above gap portion S can be sealed with a brazing material.

When the thickness CB of the tube 40 (refer to FIG. 1 and FIG. 3) is to be made thinner in order to reduce pressure loss in the air, it is achieved by reducing the thickness of the tube portions 33, 43 of the adjoining core elements 16 and the tube portions 63, 73 of the adjoining core elements 17 at the end portions. At this time, there is no change in the size of the portion where the inlet-side flat plate portions 31, 41 and the outlet-side flat plate portions 32, 42 of the adjoining core elements 16 and the inlet-side flat plate portions 61, 71 and the outlet-side flat plate portions 62, 72 of the adjoining core elements 17 at the end portions compared with the current size even if the thickness CB of the tube 40 is made smaller.

In other words, even if the thickness CB of the tube 40 is reduced, the strength of the joint between the adjoining core elements 16 and the adjoining core elements 17 at end portions is sufficiently maintained. Accordingly, there is no possibility of separation between the side plates 3, 6 on one side and the side plates 4, 7 on the other side which are adjoining each other. The thickness CB of the tube 40 can be thus reduced.

It is therefore possible to reduce the pressure loss in the air in the core portion 10, thereby increasing the capacity of the air introduced into the core portion 10.

In addition, since the proportion of the tube 40 to the whole core portion 10 can be reduced, it is conversely possible to increase the proportion of the fin portion 20 having high heat transfer performance to the whole core portion 10, thereby improving the heat radiating performance of the fin portion 20.

Figure 15:
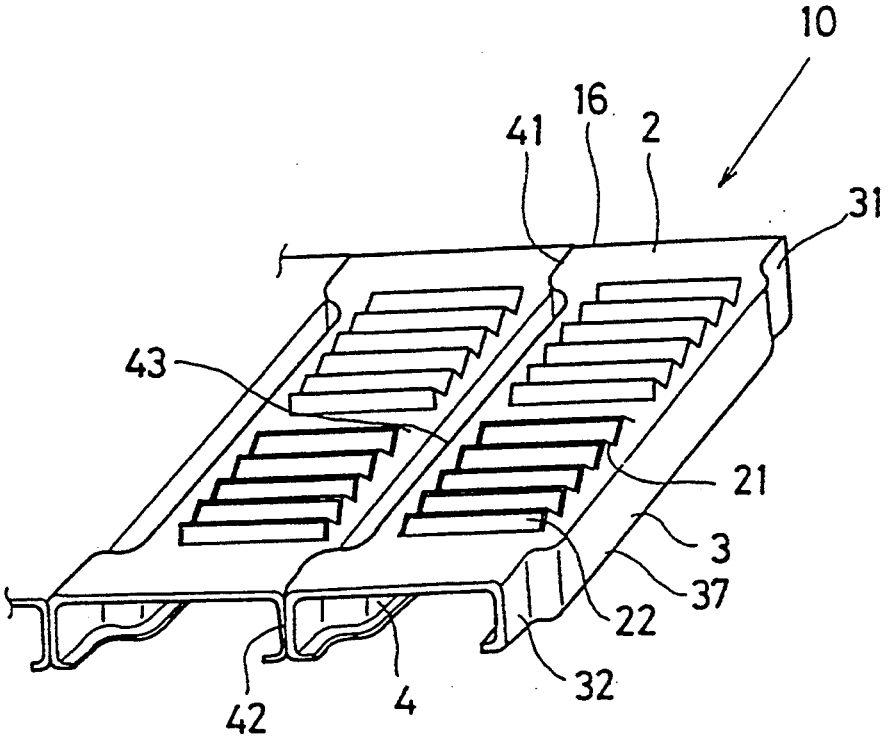
FIG. 15 is a perspective view showing a part of a core portion of a laminated heat exchanger of a second embodiment of the present invention.

FIG. 15 shows a second embodiment of the present invention and shows a part of a core portion of a laminated heat exchanger. A core element 16 has a projection portion 37 on a side plate 3 on one side thereof, which is projected in the direction of the width of a core portion 10 relative to an inlet-side flat plate portion 31 and an outlet-side flat plate portion 32. A side plate 4 on the other side has a tube portion 43 which is recessed with respect to an inlet-side flat plate portion 41 and an outlet-side flat plate portion 42.

Such a configuration of the core element 16 provides an effect that relative positioning of adjoining core elements can be easily performed when the core portion 10 is assembled, and thus misalignment between the inlet-side flat plate portions 31, 41 and the outlet-side flat plate portions 32, 42 can be avoided.

Figure 16:
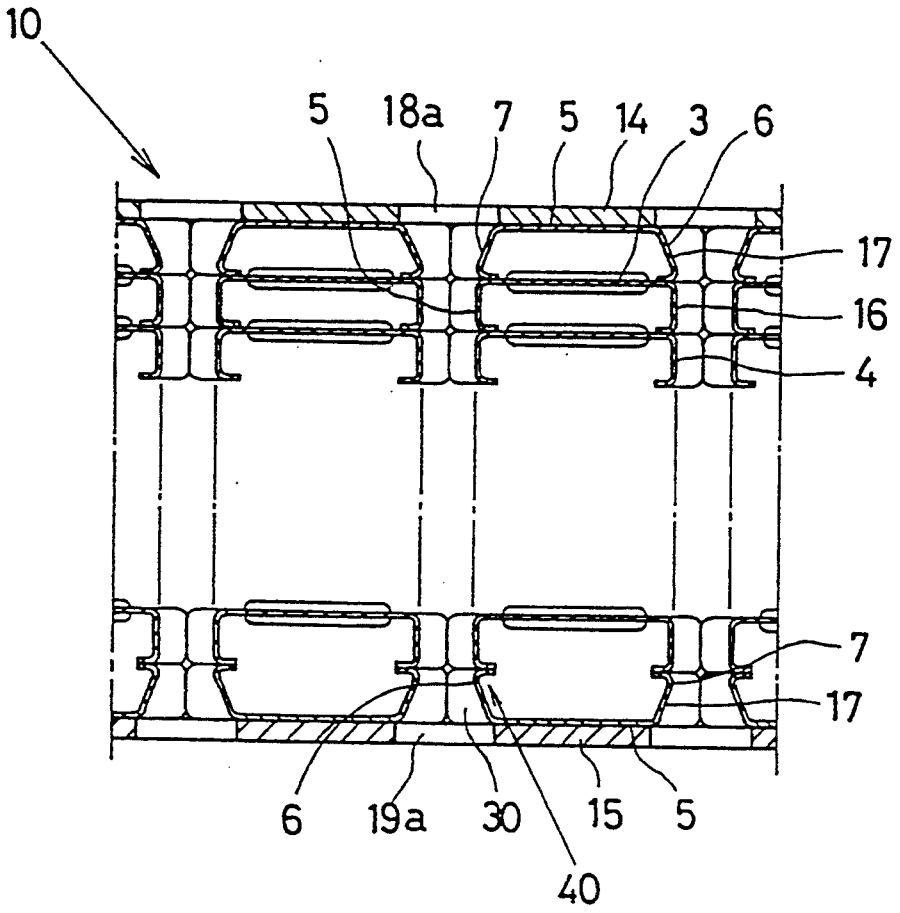
FIG. 16 is a perspective view showing a part of a core portion of a laminated heat exchanger of a third embodiment of the present invention.

FIG. 16 shows a third embodiment of the present invention and shows a core portion of a laminated heat exchanger. Upper and lower core plates 14, 15 of a core portion 10 have a shape like a flat plate and the cylindrical portions 18, 19 are not formed on it. Instead of the cylindrical portions 18, 19, communication holes 18*a*, 19*a* for providing communication between upper and lower tanks 11, 12 and tubes 40 are formed in the upper and lower core plates 14, 15.

Figure 17:
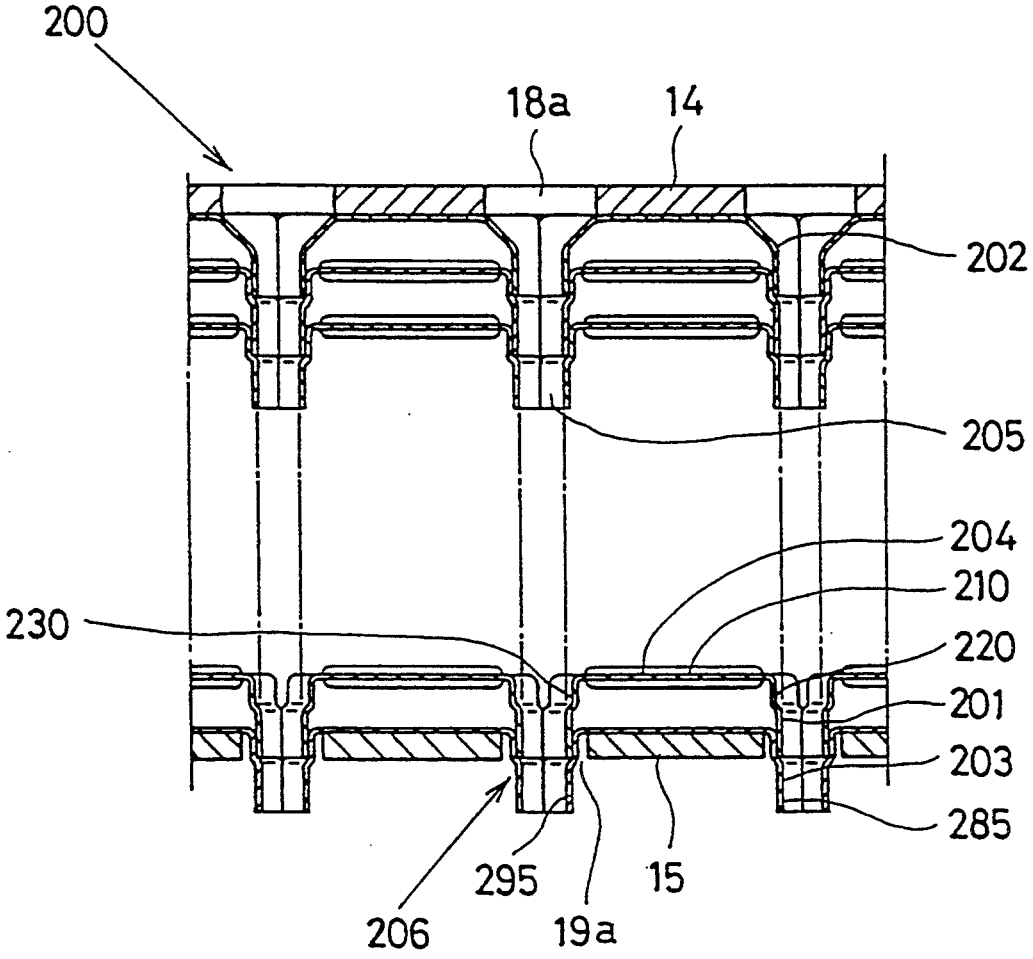
FIG. 17 to FIG. 21 show a fourth embodiment of the present invention.
Figure 18:
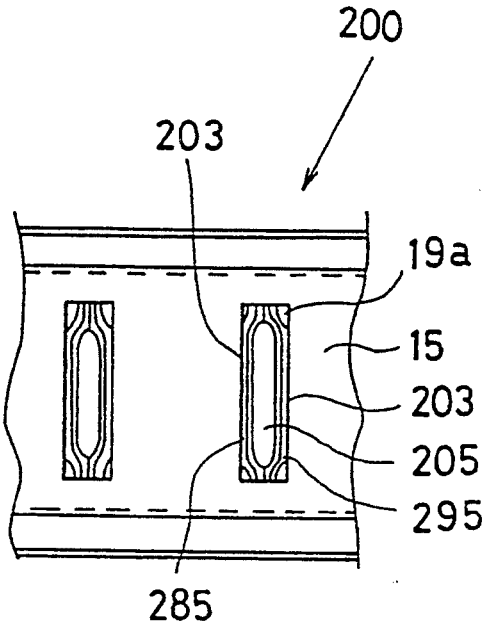

FIG. 17 to FIG. 21 show a fourth embodiment of the present invention. FIG. 17 and FIG. 18 show a core portion of a laminated heat exchanger. A fin portion 204, flow paths 205 and tubes 206 are formed on this core portion 200 by laminating a plurality of core elements 201, upper end core elements 202 and lower end core elements 203 between upper and lower core plates 14, 15 having communication holes 18*a*, 19*a*, respectively.

Figure 19:
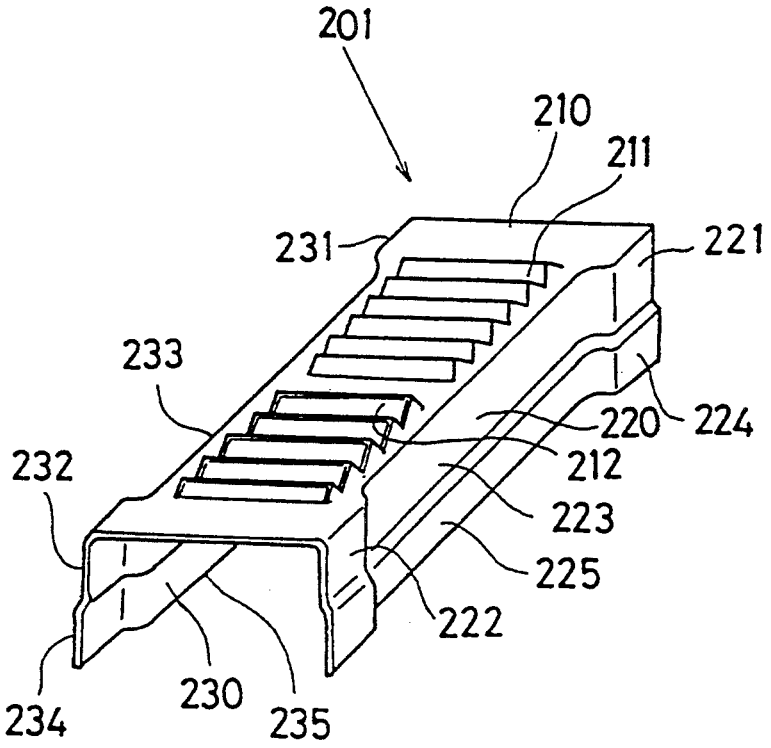

FIG. 19 shows the core element 201. The core element 201 has a fin plate 210 and side plates 220, 230 on one and the other sides. A plurality of louvers 211 and a plurality of slits 212 are formed on a fin plate 210 just as in the first embodiment. The side plates 220, 230 on one and the other sides have inlet-side flat plate portions 221, 231, outlet-side flat plate portions 222, 232, and tube portions 223, 233 which are formed in the same way as in the first embodiment. The side plates 220, 230 on one and the other sides have, instead of the joint flaps in the first embodiment, first skirt portions 224, 234 which are outwardly offset by an amount corresponding to the thickness of the plate relative to the inlet-side flat plate portions 221, 231 and the outlet-side flat plate portions 222, 232 and second skirt portions 225, 235 which are outwardly offset by an amount corresponding to the thickness of the plate relative to the tube portions 223, 233.

With such a configuration, when the core elements 201 are laminated, the first skirt portions 224, 234 are brazed to the inlet-side flat plate portions 221, 231 and the outlet-side flat plate portions 222, 232 of a core element 201 on the level immediately thereunder. Furthermore, the second skirt portions 225, 235 and the tube portions 223, 233 of the core element on the level immediately thereunder are brazed together.

Figure 20:
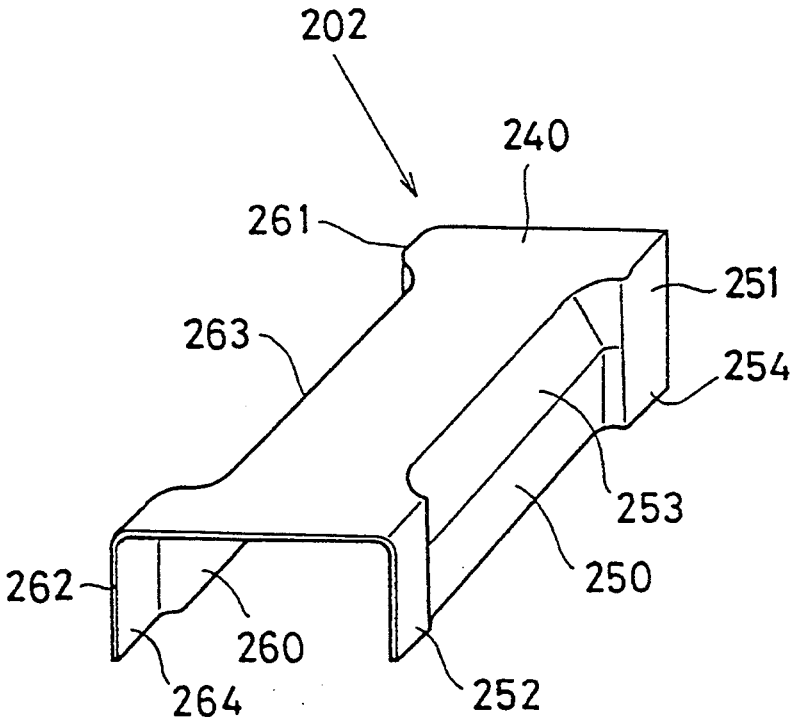

FIG. 20 shows an upper end core element 202. The upper end core element 202 is for maintaining watertightness between the upper core plate 14 and the uppermost core element 201. The upper end core element 17 has a connecting plate 240 and side plates 250, 260 on one and the other sides. The connecting plate 240 has a structure similar to that in the first embodiment. Inlet-side flat plate portions 251, 261, outlet-side flat plate portions 252, 262, and tube portions 253, 263 having a tapered surface are formed on the side plates 250, 260 on one and the other sides. Joint flaps 254, 264 having a shape like a flat plate are formed at the tips of the inlet-side flat plate portions 251, 261, the outlet-side flat plate portions 252, 262, and the tube portions 253, 263, the joint flaps 254, 264 being brazed to the inlet-side flat plate portions 221, 231 ad the outlet-side flat plate portions 222, 232, and the tubes 223, 233 of a core element 201 on the level immediately thereunder.

Figure 21:
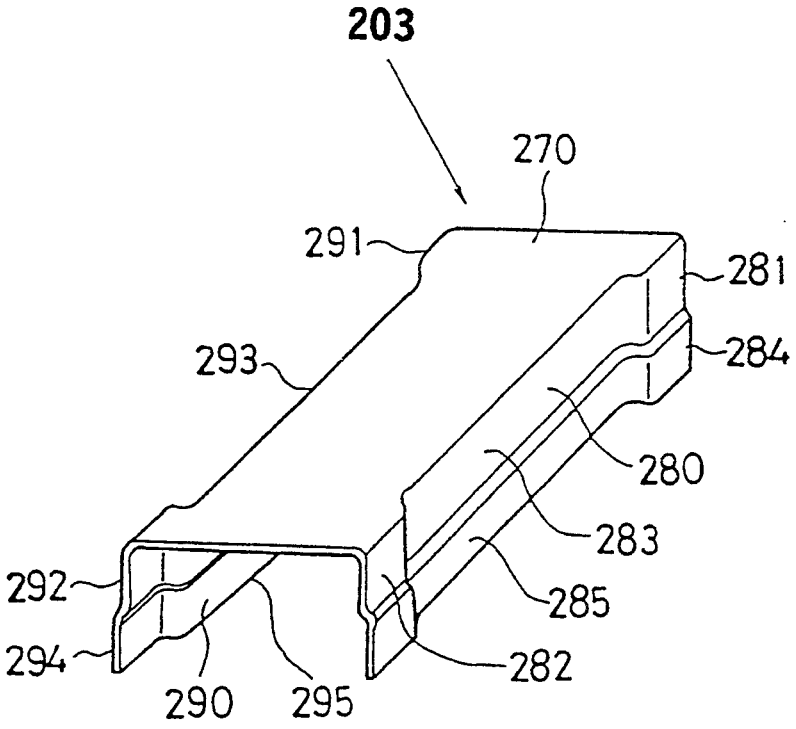

FIG. 21 shows a lower end core element 203. The lower end core element 203 is for maintaining watertightness between the lower core plate 15 and the lower-most core element 201. The lower end core element 203 has a fin plate 270 and side plates 280, 290 on one and the other sides.

Just as the above-described core element 201, the side plates 280, 290 on one and the other sides have inlet-side flat plate portions 281, 291, outlet-side flat plate portions 282, 292, tube portions 283, 293, first skirt portions 284, 294, and second skirt portions 285, 295.

The first skirt portions 284, 294 and second skirt portions 285, 295 are inserted in a communication hole 19*a* of the lower core plate 15 so that their ends project.

Figure 22:
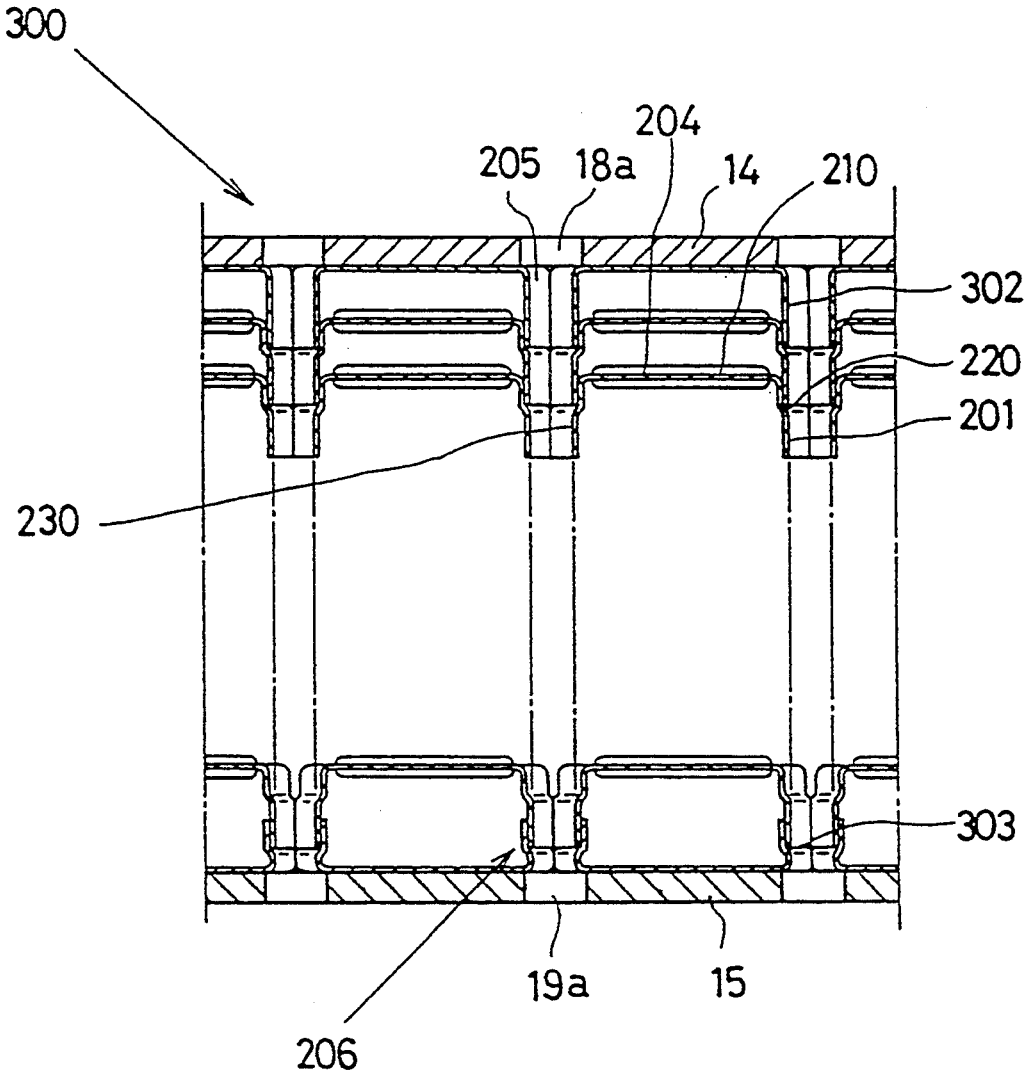
FIG. 22 to FIG. 24 show a fifth embodiment of the present invention.
Figure 24:
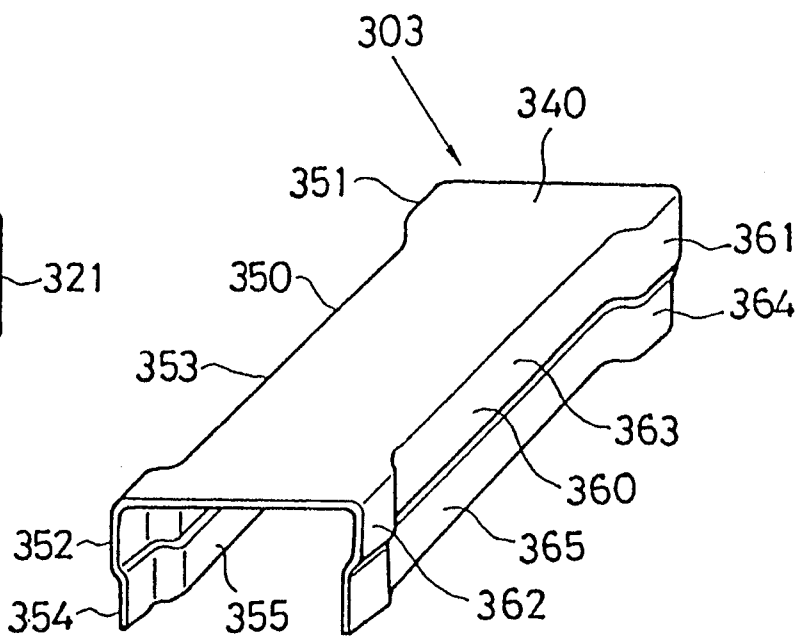
Figure 23:
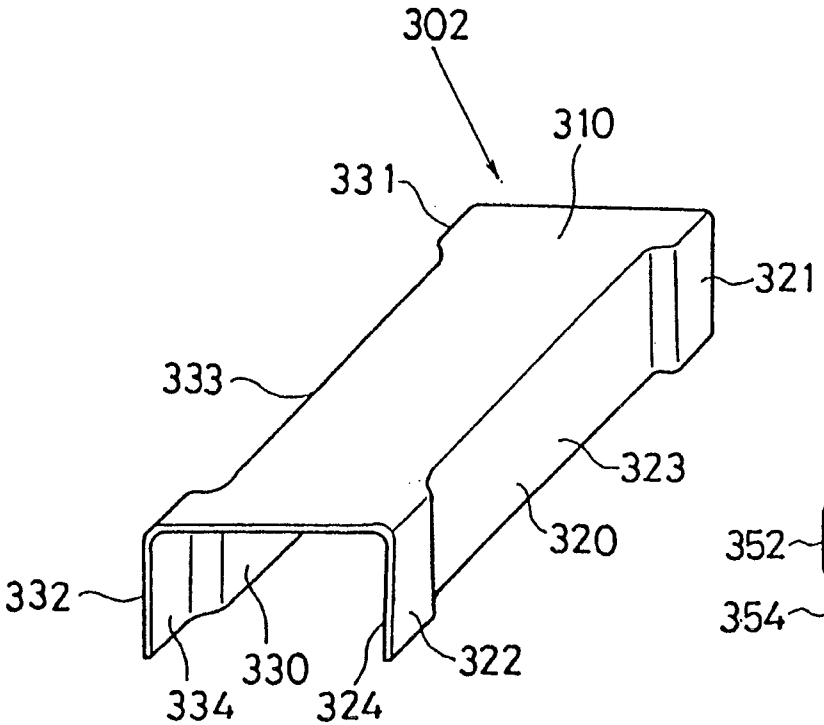

FIG. 22 to FIG. 24 show a fifth embodiment of the present invention. FIG. 22 shows a core portion of a laminated heat exchanger. The core portion 300 has an upper end core element 302 and a lower end core element 303 which have shapes modified from those of the upper end core element and lower end core element in the fourth embodiment and which are used instead thereof.

FIG. 23 shows the upper end core element 302. The upper end core element 302 has a connecting plate 310 and side plates 320, 330 on one and the other sides. Inlet-side flat plate portions 321, 331, outlet-side flat plate portions 322, 332, tube portions 323, 333 without a tapered surface and joint flaps 324, 334 are formed on the side plates 320, 330 on one and the other sides.

FIG. 24 shows the lower end core element 303. The lower end core element 303 has a connecting plate 340 and side plates 350, 360 on one and the other sides. The side plates 350, 360 on one and the other sides have first skirt portions 354, 364 which are inwardly offset by an amount corresponding to the thickness of the plate relative to inlet-side flat plate portions 351, 361 and outlet-side flat plate portions 352, 362 and second skirt portions 355, 365 which are inwardly offset by an amount corresponding to the thickness of the plate relative to tube portions 353, 363.

The first skirt portions 354, 364 and the second skirt portions 355, 365 are brazed to the first skirt portion 224, 234 and the second skirt portions 225, 235 which are offset of the core element 201 on the level immediately above them.

Figure 25:
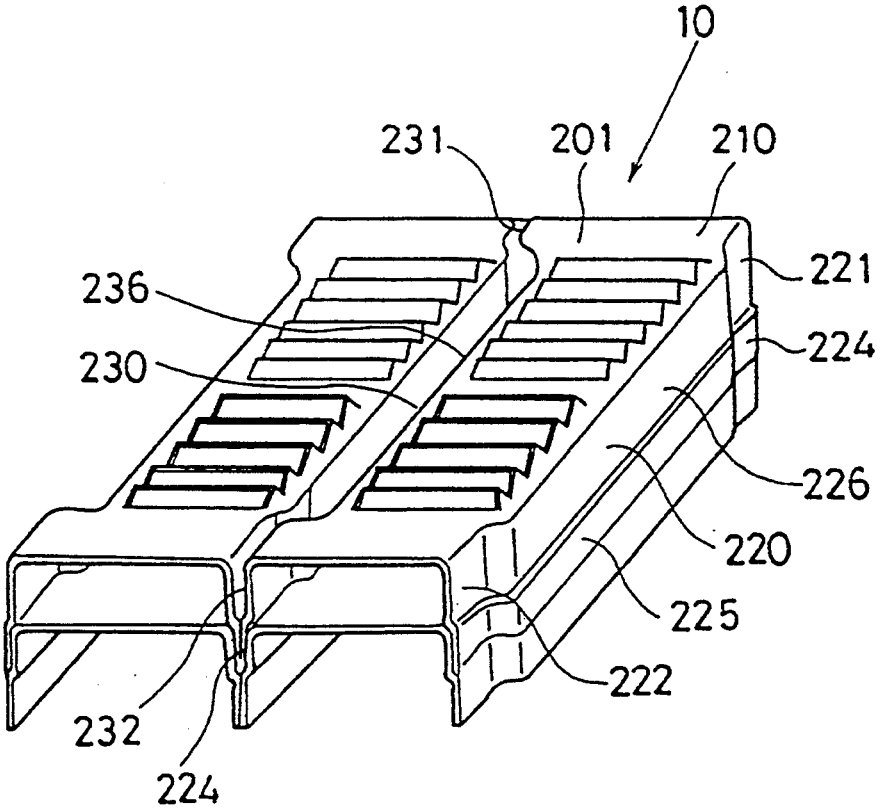
FIG. 25 is a perspective view showing a part of a core portion of a laminated heat exchanger of a sixth embodiment of the present invention.

FIG. 25 shows a sixth embodiment of the present invention and shows a part of a core portion. Core elements 201 used in this core portion 220 are the combination of those in the first and second embodiments. A projection portion 226 is formed on a side plate 220 on one side, and a tube portion 236 which is largely recessed is formed on a side plate 230 on the other side. The core elements 201 in this embodiment are similar to those in the second embodiment in that they provide an effect that relative positioning of adjoining core elements 201 can be easily performed during the assembly of the core portion 10, thus avoiding misalignment between inlet-side flat plate portions 221, 231 and outlet-side flat plate portions 222, 232.

Although the present invention is applied as a radiator in the above embodiments, it may be applied as a heater core of a hot-water heater, an evaporator or condenser of a cooler, or various other laminated heat exchangers such as an oil cooler.

Although a core portion is constructed by laminating a plurality of core elements in the direction of the width and in the vertical direction (the flowing direction of the second heat medium) of a laminated heat exchanger in the above embodiments, the core portion may be constructed by laminating the first and second core elements in plurality only in the flowing direction of the second heat medium of a laminated heat exchanger. Also, the first and second core elements may be laminated in plurality horizontally across a laminated heat exchanger (in the flowing direction of the first heat medium).

In the above embodiments, the tube portions are provided on the side plates on both sides of a core element. However, the tube portions may be provided only on the side plate on one side (the first side plate).

Figure 26:
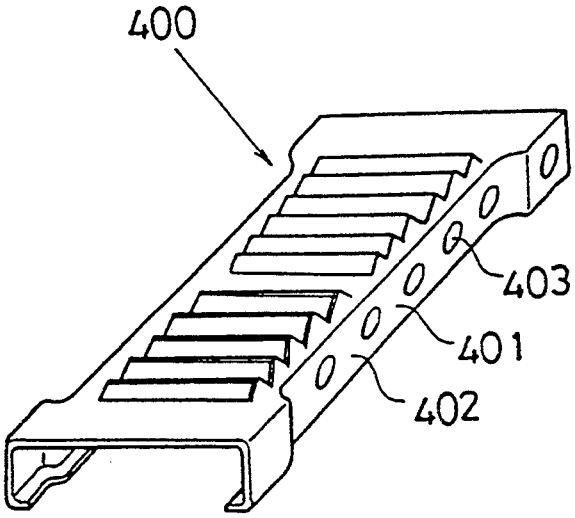
FIG. 26 to FIG. 28 are perspective views showing an example of a modification of a core element.
Figure 27:
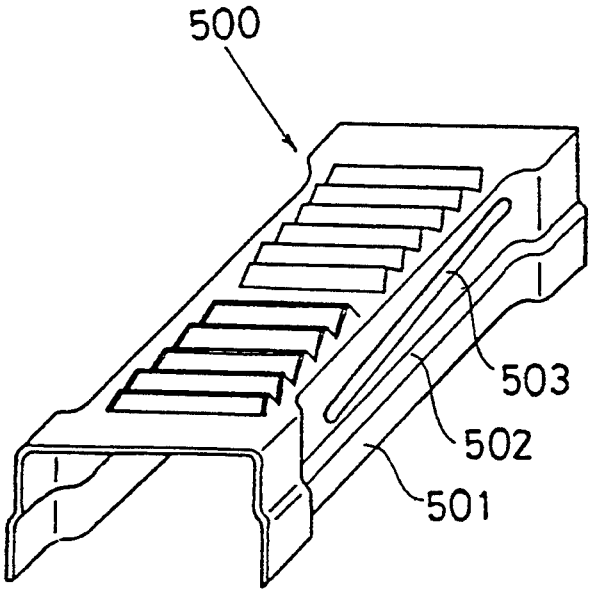

Although the plurality of flat plate portions are provided at the upstream and downstream ends, in terms of the flowing direction of the air, of the side plates, the plurality of flat plate portions may be provided in any position on the side plates. For example, two flat plate portions may be provided near the middle of the side plates. It is also possible to use, as the first and second core elements, core elements 400 and 500 as shown in FIG. 26 and FIG. 27 which have dimples 403 and a rib 503 formed on tube portions 402 and 503 of side plates 401 and 502 on one side, respectively.

Figure 28:
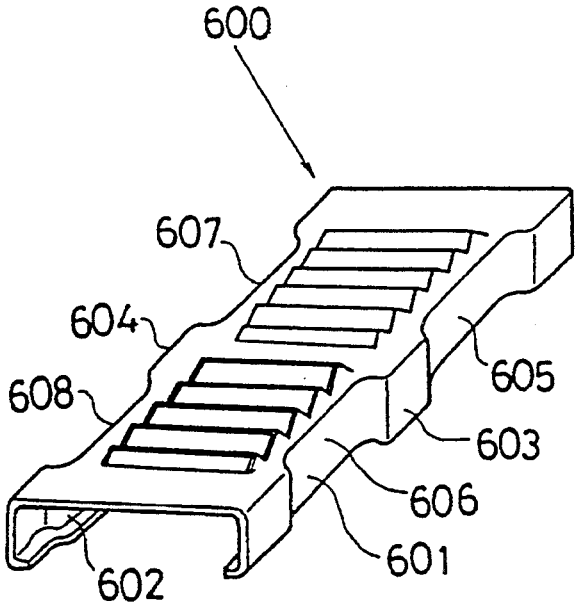

Furthermore, a core element 600 on which intermediate flat plate portions 603, 604 have been added to side plates 601, 602 on one and the other sides to form two tube portions 605, 606, 607, 608 as shown in FIG. 28 may be used as the first and second core elements. Two or more intermediate flat plate portions 603, 604 may be added to the side plates 601, 602 on one and the other sides to form three or more tube portions on the side plates 601, 602 on one and the other sides.

Figure 29:
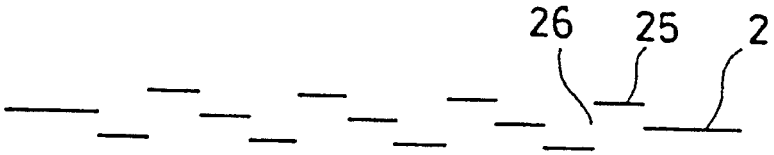
FIG. 29 is a sectional view showing examples of modifications of louvers and slits of a fin plate.
Figure 30:
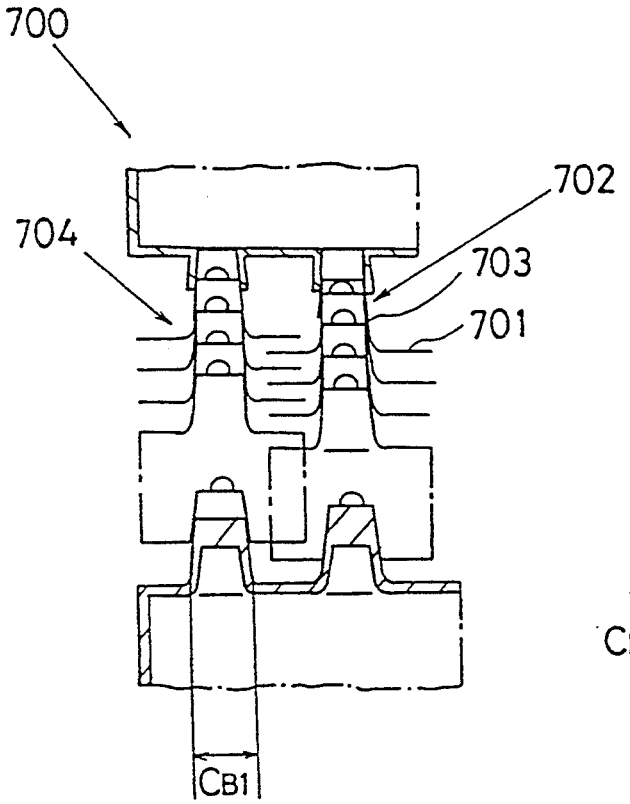
PRIOR ART FIG. 30
FIG. 30 is a sectional view showing a conventional laminated heat exchanger.
Figure 31:
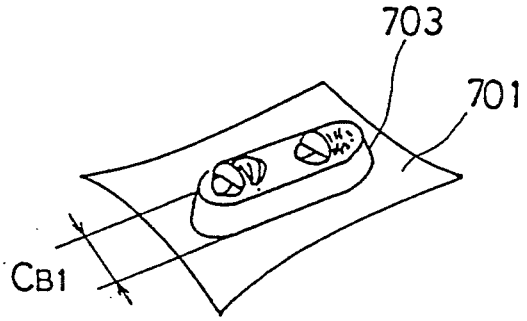
PRIOR ART FIG. 31
FIG. 31 is a perspective view showing a conventional fin plate.

The sectional shades of the louvers and slits are not limited to those described in the above embodiments and may be any shape. For example, the shapes of the louver 25 and slit 26 of the fin plate 2 shown in FIG. 29 may be employed.

What is claimed is:

1. A heat exchanger having a core formed by laminating a plurality of core elements, said core elements comprising:

a fin plate disposed along a flowing direction of a first heat medium, said fin plate having a flat surface portion and a plurality of louvers forming packages therethrough; and a side plate provided on each side of said fin plate along the flowing direction of said first heat medium, said side plates being extended in a direction substantially perpendicular to said flat surface portion of said fin plate, each side having at least two side flat portions spaced from each other, and each side plate having a tube portion formed by a depression in said side plate with respect to said side flat portions, wherein said side flat portions and said tube portion form a continuous surface;

wherein a plurality of said core elements are laminated one upon another forming one column of said core, and a plurality of said columns are joined at said side flat portions of said plurality of core elements of said respective column, thereby forming a second heat medium flow path between said tube portions of adjacent core elements; and wherein a second heat medium flows through said second heat medium flow path to exchange heat with said first heat medium.

2. A heat exchanger according to claim 1, wherein said core elements are integrally formed from a single piece of material.

3. A heat exchanger including a first and a second heat exchanging element, said first and second heat exchanging elements each comprising;

two side walls each having at least two joint surfaces separated from each other in a flowing direction of a first medium extending in a direction substantially perpendicular to said flowing direction of said first medium, and each having a tube surface forming a depression with respect to said joint surfaces; and a fin plate having a plurality of louvers forming passages therethrough and connected between said two side walls, said two side walls and said fin plate forming a flow path through which said first medium flows in said flowing direction;

wherein corresponding joint surfaces of said first and second heat exchanging elements are joined in a face-to-face relationship to form, by said tube surfaces, a flow path through which a second medium flows in a direction substantially perpendicular to said flowing direction of said first medium, thereby causing a heat exchange between said first medium and said second medium.

4. A heat exchanger according to claim 3, wherein said plurality of louvers are disposed parallel to each other and project from said fin plate.

5. A structure of a core member for a heat exchanger according to claim 4, wherein said side plate has joint flaps which are jointed to said fin portion of other core element and bent in the form of hooks at the tips of said side plates.

6. A heat exchanger according to claim 4, wherein said plurality of louvers are arranged in groups separated by a plane surface.

7. A heat exchanger according to claim 6, wherein said plurality of louvers are arranged in two groups separated by a plane surface and are disposed symmetrically about a perpendicular plane with respect to said plane surface.

8. A heat exchanger according to claim 7, wherein said plurality of louvers are arranged in two groups separated by a plane surface and said groups of louvers are symmetrical about a perpendicular plane with respect to said plane surface.

9. A heat exchanger according to claim 4, wherein said plurality of louvers are arranged to form a staggered radially symmetrical pattern about said fin plate.

10. A core element constituting a fin of a heat exchanger comprising:

a fin plate having a flat surface portion and a plurality of louvers forming passages therethrough;

two side plates provided at end portions of said fin plate and extended in a direction substantially perpendicular to said flat surface portion, said two side plates each having a tube portion forming an inward depression.

* * * * *

UNITED STATES PATENT AND TRADEMARK OFFICE

CERTIFICATE OF CORRECTION

PATENT NO. : 5,373,895
DATED : December 20, 1994
INVENTOR(S) : Yamamoto, et. al.

It is certified that error appears in the above-indentified patent and that said Letters Patent is hereby corrected as shown below:

Title page, under item [22] insert--

-- [22] PCT Filed: April 7, 1993

-- [86] PCT No.: PCT/JP91/00985 --

-- § 371 Date: April 7, 1993 --

-- § 102(e) Date: April 7, 1993 --

-- PCT Pub No.: WO92/02774

-- PCT Pub. Date: February 20, 1992

Signed and Sealed this

Second Day of January, 1996

Bruce Lehman

*Attest:*

BRUCE LEHMAN

*Attesting Officer*

*Commissioner of Patents and Trademarks*